United States Patent [19]

Speer

[11] 4,316,673

[45] Feb. 23, 1982

[54] MIXING DEVICE FOR SIMULTANEOUSLY DISPENSING TWO-PART LIQUID COMPOUNDS FROM PACKAGING KIT

[75] Inventor: Spencer J. Speer, Ontario, Calif.

[73] Assignee: General Dynamics, Pomona Division, Pomona, Calif.

[21] Appl. No.: 93,360

[22] Filed: Nov. 13, 1979

Related U.S. Application Data

[62] Division of Ser. No. 932,053, Aug. 8, 1978, Pat. No. 4,204,775.

[51] Int. Cl.[3] ..... B01F 5/06

[52] U.S. Cl. ..... 366/337; 366/340

[58] Field of Search ..... 366/336, 337, 338, 339, 366/340; 138/38, 42; 48/180 R, 180 B

[56] References Cited

U.S. PATENT DOCUMENTS

| | | | |
|---|---|---|---|
| 1,741,019 | 12/1929 | Harrington | 366/338 |
| 3,460,809 | 8/1969 | Hauss | 366/338 |
| 3,476,521 | 11/1969 | Wise | 366/336 |
| 3,835,886 | 9/1974 | Zajac | 366/336 |
| 4,027,857 | 6/1977 | Cunningham | 366/340 |
| 4,121,906 | 10/1978 | Oldham | 366/336 |
| 4,125,334 | 11/1978 | Jones | 366/336 |
| 4,183,681 | 1/1980 | Li | 366/336 |
| 4,183,682 | 1/1980 | Lieffers | 366/339 |

*Primary Examiner*—Robert W. Jenkins

*Attorney, Agent, or Firm*—Henry M. Bissell; Edward B. Johnson

[57] ABSTRACT

A molded, disposable mixing device is disclosed for mixing and dispensing a two-part fluid compound. The device may consist of two mirror-image portions or structures, each being of semi-cylindrical shape and providing a tortuous path for shearing, folding, mixing and blending together the two fluids. Each of the two structures is provided with a male attachment lug, and a female detent for securing them together. Also, each structure has a semicircular, externally molded ridge for connecting it, for example, to a nozzle. The tortuous path may consist of two periodically intersecting paths, or else of a generally open passage provided with mixing blades or baffles disposed at regular or irregular intervals. The mixing may also be effected by a spirally folded mesh or spherical objects disposed in a single tubular structure.

14 Claims, 10 Drawing Figures

MIXING DEVICE FOR SIMULTANEOUSLY DISPENSING TWO-PART LIQUID COMPOUNDS FROM PACKAGING KIT

This is a division of application Ser. No. 932,053, filed Aug. 8, 1978, now U.S. Pat. No. 4,204,775.

BACKGROUND OF THE INVENTION

1. Field of the Invention

The present invention relates generally to mixing devices for mixing a two-part fluid compound and, more particularly, relates to such a mixing device which is disposable after use.

2. Description of the Prior Art

It has been a long-standing problem to provide a packaging kit for packaging or containing a two-part fluid, such as a liquid or semi-liquid. In this context, a semi-liquid contains a high concentration of solids such, for example, as an epoxy which may be loaded with powdered metal. Many of such two-part fluids require mixing immediately before use, and precise metering in predetermined proportions. Among examples are epoxy compounds which when mixed, will harden in a very short period of time. Other examples are certain pharmaceuticals which may have to be precisely metered and mixed or applied in the same spot to provide synergistic action. Some of these liquids or semi-liquids are very viscous; others are not.

It is therefore desirable to provide a disposable mixing chamber for mixing the two liquids or semi-liquids at the point of use. The mixing device, to which the present invention relates, may advantageously be used with the disposable shipping containers disclosed in applicant's copending application, Ser. No. 932,054, filed Aug. 8, 1978, now U.S. Pat. No. 4,204,775.

Many mixing devices have been devised in the past. Most of these are rigid, metal-like structures which are permanently installed in some industrial plant. Such a mixer has been disclosed, for example, in the patent to Lyons, U.S. Pat. No. 832,400. The structure is provided with a steel hopper feed and triangularly-shaped bars forming internal passages for the dry mixing of certain cereals, such as rice. A fluid mixer-dispenser is revealed in the patent to Frederick, U.S. Pat. No. 3,746,216. In accordance with the patent, the mixing chamber is disposed internally of a dispensing tube. The mixing ducting has a specified geometry and includes stacked discs and the like. A two-stage mixing is effected by the device. A mixing, homogenizing and emulsifying apparatus is disclosed in the patent to Schmitt, U.S. Pat. No. 3,770,249. Here individual mixing chambers are disposed in series and connected to each other by pipes. Again the apparatus is intended for permanent installation and consists of a steel or metal sandwich structure. Another mixing device is shown in the patent to Clark et al., U.S. Pat. No. 3,861,652. This mixing device includes a series of curved, dividing elements within a hollow tube. The curved elements are spaced from each other by fine mesh screens interposed therebetween. The device is intended for permanent in-line positions, and has two input ports. It could not be used, for example, for laying down beads or a continuous stream of mixed material, such as may be used for connecting different structures to each other by an adhesive.

The patent to Simpson, U.S. Pat. No. 3,941,355, relates to a mixing insert for foam dispensing apparatus. The mixing is effected by a series of lands consisting of discs disposed about an internal shaft in the mixing chamber. Again the device is intended for permanent installation onto a dispenser. Such a device again would not be useful for laying down beads and the like. The patent to Cunningham, U.S. Pat. No. 4,027,857, discloses a static mixer for flowable materials. The mixer is intended for permanent mounting in injection molding equipment. The mixer ducts are made by drilling suitable holes into the mixer element which typically consists of stainless steel. The mixer includes four separate ducts. The patent to Gray, U.S. Pat. No. 4,068,830, is directed to a mixing method and system. It has a tubular mixer of steel with perforated baffle plates internal of the mix stream. The mixer features two inlet ports, and is again, intended for permanent installation.

The patent to Van Sciver II, U.S. Pat. No. 3,159,312, shows a dispensing device for mixing two viscous fluids. It includes flexible, disposable plastic tubing formed to provide a series of duct interchanges with internal fluid-detecting vanes at the interchanges. The deflecting vanes are disposed only at the fluid interchanges and two separate passageways are provided. The mixing tubes may be formed by electrofusion, welding or thermoplastic injection molding. Bead lay-down or injection with such a device is not practical.

Various other patents relating to mixing devices are provided with flat structures so that a tortuous path is disposed between, say two flat plates. An example of such a device is shown in the patent to Hazlehurst et al., U.S. Pat. No. 3,459,407. The mixer has two separate intake ports, and is intended for permanent installation on fluid feedlines. For the complete mixer, a minimum of three parts is necessary. Contiguous cavities are formed by drilling blind holes. Another flat structure is shown in the patent to Althausen et al., U.S. Pat. No. 3,924,989. It reveals a machine for producing moldings and is intended for permanent installation in an injection molding system. The mixing chamber may be made from slab-like structures with milled-in grooves to form ducts with obstacles. Again a two-port input is used. A device of this type could not be used for laying down beads.

The two patents to Moore, U.S. Pat. Nos. 3,927,868, and 4,002,289, both disclose a static-type mixer. The mixer is a flat, sheet-strip structure having two-port intake lines. The resulting mixer is a thin, flexible structure which, due to its flexibility, could not be used to direct a stream of mixed fluids and, hence, could not be used for laying down beads and the like.

The patent to Skobel, U.S. Pat. No. 3,623,704, is directed to a static mixing device having a single point of entry and features a pistollike grip so that it can be held by hand. The mixing device features a very tortuous path which is provided by a plurality of elements which are in turn removable. The pistol grip includes a trigger valving mechanism. The patent to Cochran, U.S. Pat. No. 3,045,984, reveals a fluid blender made of metal for a permanent installation. It is provided with baffles permanently mounted by welding in a hollow tube. The blender is intended for a continuous line flow.

Various other patents relating to mixers show helix-like structures. Among these patents is a Warren patent, U.S. Pat. No. 1,626,487, relating to an emulsifier. The patent discloses a permanent steel structure placed in a fluid feedline. An internal spindle is provided with spiral blades attached thereto for mixing. A somewhat similar mixer construction is disclosed in the patent to Hooker et at., U.S. Pat. No. 2,000,953. Again the mixer consists of a permanent steel structure for mixing gas with semi-fluid materials. A helix is provided which is wound around a central shaft for mixing.

SUMMARY OF THE INVENTION

In accordance with the present invention, there is provided a disposable fluid mixing device. The mixing device may include, for example, two mirror-image structures. Each of the two structures may otherwise be identical and may be molded to provide a generally, semi-cylindrical structure. Each structure may have an input chamber which, when assembled, is of generally semi-spherical shape followed by a tortuous path molded into the two structures. Each of the structures is provided with one or more externally molded, semicircular ridges for securing thereto a nozzle or the like. Such a nozzle may, for example, take the form shown in the applicant's prior U.S. Pat. No. 4,040,420. The input chamber may be provided with a molded, semi-spherical groove in each of the structures at the input end. This will permit connection thereto of the disposable fluid container disclosed in the applicant's copending application referred to above.

Each of the structures may be provided with suitable means for connecting them together. This may, for example, take the form of a male lug and a female detent spaced from each other along the longitudinal open sides of each of the structures.

The novel features that are considered characteristic of this invention are set forth with particularity in the appended claims. The invention, itself, however, both as to its organization and method of operation, as well as additional objects and advantages thereof, will best be understood from the following description when read in connection with the accompanying drawings.

DESCRIPTION OF THE PREFERRED EMBODIMENT

Figure 1:
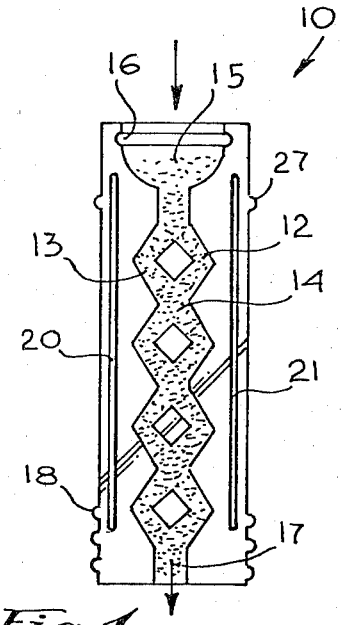
FIG. 1 is a front elevational view of one half of a mixing container embodying the present invention.
Figure 2:
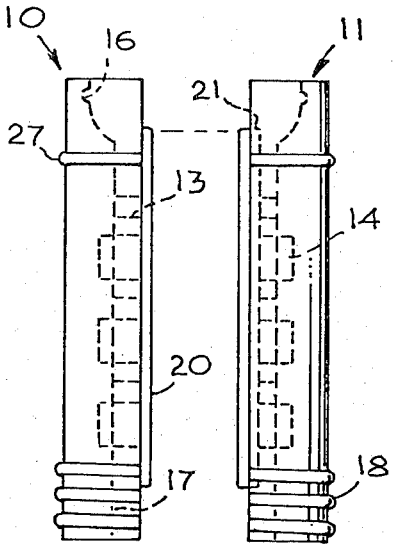
FIG. 2 is a side elevational view of two mirror-image sections making up the complete mixing device.
Figure 3:
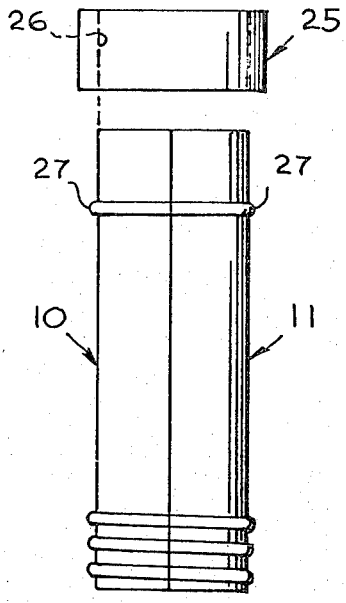
FIG. 3 is an exploded view of the assembled mixer and a retaining ring therefor.

Referring now to the drawings, and particularly to FIGS. 1–3, there is illustrated a preferred embodiment of the present invention. FIG. 1 is a front elevational view of one half of the mixing device of the invention. FIG. 2 shows a side elevational view of the two structures making up the mixing device, while FIG. 3 is an exploded view of the assembled mixing device with a retaining ring.

It should be noted that the structure of FIGS. 1–3 has also been disclosed but not claimed in the applicant's copending application, referred to above.

Frequently it is desired to dispense and mix at the point of application a two-part, fluid compound. Among these fluids are certain epoxy compounds which harden rapidly when mixed. Among other applications are certain pharmaceuticals which may have to be applied at the same point to obtain a synergistic effect. In many cases, the two fluids have to be precisely metered in predetermined quantities.

Referring now to FIGS. 1–3, there is illustrated a mixing device for simultaneously dispensing a two-part fluid compound. This may, for example, be obtained from the packaging kit of the copending application. FIG. 1 illustrates a front elevation of one half of the two-part mixing device. The structure 10 may, for example, be molded of a plastic material. It consists of a semi-cylindrical structure 10 having molded therein a tortuous fluid path 12, 13. The two fluid passages 12 and 13 are shown to join or intersect each other, as shown at 14, and divide again through a certain length of the structure 10. The tortuous paths thus provided serve the purpose to improve shearing of fluids and mixing thereof. Also, the fluids are folded back upon themselves. The liquid passages may meet each other at right angles or other suitable angles.

Thus, the structure of FIG. 1 may be visualized as being an almost solid, semi-cylinder having suitable passages 12 and 13 therein. The structure 10 is also provided with an input chamber 15 having an internal groove 16 which may mate with the external ridges of a two-part fluid container. The input chamber 15 formed by the two structures 10 and 11 may be of semi-spherical shape. The semi-cylindrical structure 10 of FIG. 1 also has an outlet opening 17. It may be provided with external, semicircular ridges 18 for connecting thereto a delivery nozzle which may be of the type disclosed in the applicant's prior U.S. Pat. No. 4,040,420.

Additionally, the structure 10 of FIG. 1 may be provided on one side with a male attachment lug 20 and on the other side with a female attachment detent 21.

FIG. 2 shows the two halves of the completed structure which are mirror images of each other and may be made identical to each other. The completed structure is illustrated in FIG. 3. It may be desirable to provide retaining means for the structure of FIG. 3. This may take, for example, the form of a ring 25 having an inner opening 26 to fit over the outer diameter of the assembled mixer of FIG. 3. In this case, each half of the mixing device may be provided with a suitable, semicircular ridge 27 to retain the ring 25.

Preferably, the structures 10 and 11 are molded of some suitable plastic. A preferred, moldable plastic is polypropylene. Alternatively, polyethylene may be used. In some cases, somewhat harder and stiffer, moldable plastic materials may be desired, such as acrylic or polystyrene.

Instead of providing a two-way, intersecting passage as shown in FIGS. 1–3, it is also feasible to provide a single, open internal passage having baffle plates therein for providing a tortuous path for the two fluids to be mixed. Such a construction has been illustrated in FIG.

4, showing a structure 30 forming one half of the completed device. The open passage is illustrated at 31 and extending therethrough are molded baffle plates 32. They are preferably connected to opposite sides of the internal wall of the semi-cylindrical structure 30 for mixing and folding the two fluids during the passage. An input chamber 33 may again be provided having an internal groove 34 for connecting it with a suitable fluid storage container. An external ridge 35 may also be provided to serve as a stop for the retainer ring 25, shown in FIG. 3.

The mating structure, not illustrated, may also be provided with mixing baffle plates which are mismatched with the baffles 32 to provide a more tortuous path.

Figure 5:
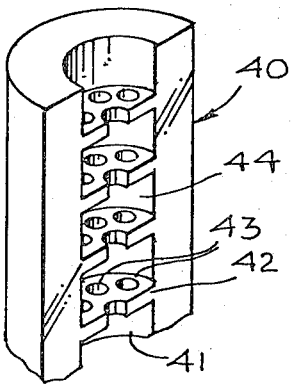
FIG. 5 is a view in perspective showing the construction of matching baffle plates.

A different construction of matching baffle plates has been illustrated in FIG. 5. The structure 40 is again of tube-like shape having an open internal passage 41 through which baffles 42 extend. As illustrated, the baffles 42 are substantially horizontal, each being provided with circular openings 43 therethrough to permit the fluid to pass therethrough. Hence, essentially a plurality of mixing chambers 44 is created. The mixing chambers 44 are divided from each other by the baffle plates 42 of the structure 40 and the mating baffle plates of the mirror-image structure.

Figure 4:
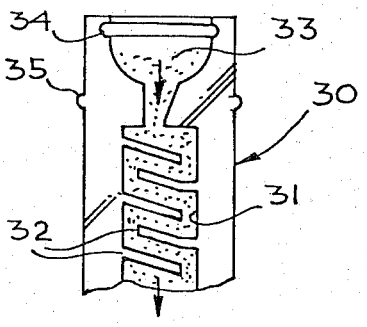
FIG. 4 is a front elevational view of a portion of a modified structure corresponding to that shown in FIG. 1 and provided with a series of baffle plates.

It will be understood that the structure of FIG. 5 does not illustrate the input chamber, such as 33, or the external ridges, such as 35 of FIG. 4, nor the means for securing the two structures to each other.

Figure 6:
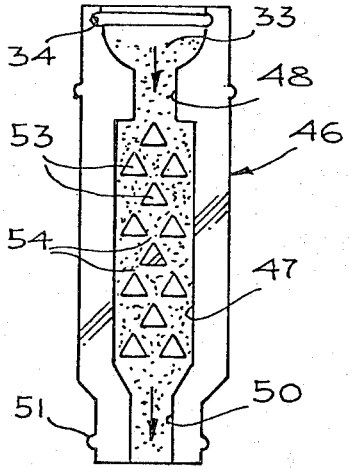
FIG. 6 is a front elevational view of another modification of one of the structures of the present invention provided with solid mixing baffles interposed into an open passageway.

FIG. 6, to which reference is now made, shows another form of solid baffles for creating a tortuous path. The structure 46 is provided with an open, internal passageway 47 which is connected to the mixing chamber 33 and its internal groove 34 through a passage 48 of smaller diameter than that of the passageway 47. The exit is formed by a passage 50 having a smaller diameter than that of the passageway 47, which may be provided with an externally molded ridge 51 for connecting thereto a suitable nozzle.

The large diameter open passage 47 is provided with a plurality of solid mixing baffles 53 of triangular cross section which may be clustered or in sequence to create small passages 54 therebetween.

The mating structure to that of FIG. 6 has baffles which mate with the baffles 53 to create liquid shearing points for mixing and folding the two fluids to be mixed.

Figure 7:
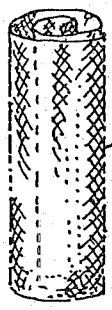
FIG. 7 is an exploded view illustrating a tube which may be single and into which a spirally folded mesh or the like may be inserted to provide additional mixing.
Figure 7:
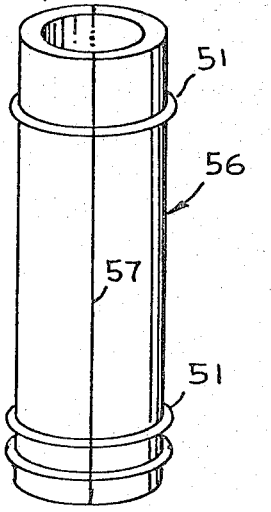

Still another mixing device is shown in the exploded view of FIG. 7. Here a tube 56 is shown which may either be a single tube, or else it may be molded of two semi-cylindrical parts, as indicated by the dividing line 57. Externally molded ridges 51 may be provided for securing thereto by snapping on and off, a mixing nozzle.

Inserted into the tube 56 is a spirally rolled mesh 60 which may consist of a flexible wire or plastic material. It is rolled and/or folded to provide the desired mixing action, for example, by folding the fluids back upon each other.

Figure 8:
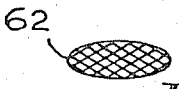
FIGS. 8 and 9 are views in perspective of, respectively, a mesh disc and a molded vane which may be used instead of the spirally folded mesh of FIG. 7.
Figure 9:
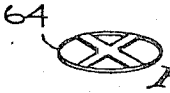

Instead of utilizing a spirally folded mesh 60, it is also feasible to insert a plurality of wire or plastic mesh discs 62, as shown in FIG. 8, into the tube 56 of FIG. 7. Alternatively, molded vanes 64 shown in FIG. 9, may be used. It will be understood that the discs 62 or the vanes 64 are inserted into the tube 56 in sufficient numbers and at appropriate angles to provide the desired mixing action.

Figure 10:
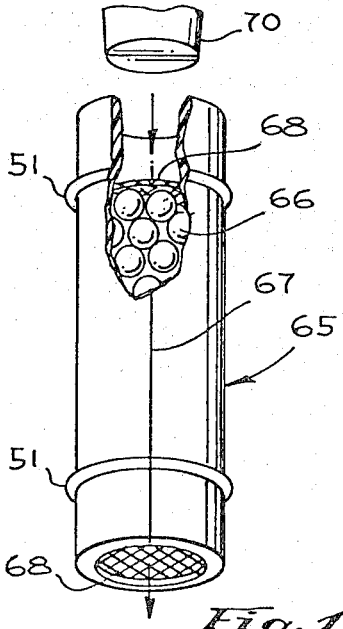
FIG. 10 is a front elevational view partly cut away of a mixer, using tubing containing spherical objects to form the fluid mixing passageways.

Instead of providing mixing by a spirally folded mesh screen 60, mesh discs 62 or molded vanes 64, it is also feasible to fill a tube 65, as shown in FIG. 10, with balls 66 or spherical objects which may be molded of a plastic material. Again, the tube 65 of FIG. 10 may consist of two semi-cylindrical portions, as indicated by the dividing line 67. The tube 65 may again be provided with externally molded ridges 51. Wire mesh retainers 68 may be provided at both ends of the tube 65 to retain balls 66. A nozzle 70 may be inserted into one end of the tube 65.

There has thus been disclosed a mixing device for a two-part fluid, such as a liquid or semi-liquid. The mixing device may be molded entirely of a plastic material, and, hence, may be manufactured very inexpensively. Hence, it is disposable after use, thus obviating the necessity of cleaning it. Preferably the mixing device consists of two mirror-image structures, which may be identical to each other. The mixing device features a tortuous path which may be provided by molded baffles, baffle plates, or other obstructions, such as ball-like objects.

Although there have been described above specific arrangements of a mixing device for simultaneously dispensing two-part liquid compounds from a packaging kit in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A disposable fluid mixing device comprising:

a first and a second structure, said structures being mirror images of each other;

each of said structures being of substantially semi-cylindrical form and having means providing a molded, tortuous path therethrough mating with the tortuous path of the other structure;

at least one semicircular ridge molded on the outside of said structure to provide means for retaining an associated element to be coupled thereto; and means for securing said structures to each other.

2. A device as defined in claim 1 wherein each of said structures includes an input chamber connected to said tortuous path.

3. A device as defined in claim 2 wherein said input chamber is provided with an internally molded detent groove for attaching thereto a fluid container.

4. A device as defined in claim 1 wherein at least two externally molded ridges are provided on each structure, said ridges being disposed adjacent the ends of each of said structures.

5. A device as defined in claim 4 wherein a retaining ring is provided having an inner diameter to fit over the outer diameter of the assembled mixing device, and where one of said ridges forms a stop for said retaining ring.

6. A device as defined in claim 1 wherein said means for securing said structures to each other consists of a male lug and a female detent provided adjacent the open, longitudinal sides of each of said structures.

7. A device as defined in claim 1 wherein said means for providing a tortuous path consists of a two-way intersecting passage separated from each other by baffles.

8. A device as defined in claim 1 wherein said means for providing a tortuous path consists of an open, internal passage provided in each of said structures and separated by a plurality of mixing baffle plates.

9. A device as claimed in claim 8 wherein said baffle plates of one of said structures match and mate the baffle plates of the other.

10. A device as defined in claim 1 wherein said means for providing a tortuous path consists of an open, internal passage in each of said structures, and solid baffles extending into said open passage to provide the tortuous path.

11. A disposable fluid mixing device comprising:

a first and a second structure, said structures being mirror images of each other;

each of said structures being of substantially semi-cylindrical form and, when joined together, having means providing a tortuous path therethrough;

at least one semi-circular ridge molded on the outside of said structure to provide means for retaining an associated element to be coupled thereto; and means for securing said structures together in the form of a cylinder.

12. A device as defined in claim 11 wherein said means for providing a tortuous path consists of a spirally rolled and folded mesh disposed in said cylinder.

13. A device as defined in claim 11 wherein said means for providing a tortuous path consists of a plurality of mesh discs disposed in an open passage through said cylinder.

14. A device as defined in claim 11 wherein said means for providing a tortuous path consists of a plurality of vanes disposed in an open passage through said cylinder.

* * * * *